US007131172B2

(12) United States Patent
Wirz

(10) Patent No.: US 7,131,172 B2
(45) Date of Patent: Nov. 7, 2006

(54) TEXTILE MACHINE TEXTURING SYSTEM AND TEXTURING NOZZLE THEREFOR

(75) Inventor: Armin Wirz, Ossingen (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 11/216,994

(22) Filed: Aug. 31, 2005

(65) Prior Publication Data

US 2006/0010666 A1 Jan. 19, 2006

Related U.S. Application Data

(62) Division of application No. 10/349,485, filed on Jan. 22, 2003, now Pat. No. 6,983,519.

(30) Foreign Application Priority Data

Jan. 25, 2002 (DE) ..... 102 02 788

(51) Int. Cl.
*D02G 1/12* (2006.01)

(52) U.S. Cl. ..... 28/266; 28/257

(58) Field of Classification Search ..... 28/247, 28/250, 254, 255, 256, 257, 262, 263, 264, 28/265, 266, 267, 278, 271, 221; 264/168, 264/211.15, 211.14, 282, 518; 57/290
See application file for complete search history.

(56) References Cited

U.S. PATENT DOCUMENTS

| | | | | |
|---|---|---|---|---|
| 3,469,293 | A | 9/1969 | Tsuzimoto et al. | |
| 3,816,887 | A * | 6/1974 | Smith et al. | 28/256 |
| 4,019,228 | A | 4/1977 | Ozawa et al. | |
| 4,030,169 | A * | 6/1977 | Enneking et al. | 28/220 |
| 4,157,604 | A | 6/1979 | Oswald et al. | |
| 4,296,535 | A | 10/1981 | Li et al. | |
| 4,301,578 | A | 11/1981 | Dammann et al. | |
| 4,558,497 | A | 12/1985 | Oswald et al. | |
| 4,620,345 | A | 11/1986 | Fleissner | |
| 4,765,042 | A | 8/1988 | Li et al. | |
| 4,974,302 | A | 12/1990 | Nabulon | |
| 5,054,173 | A * | 10/1991 | Schafer | 28/263 |
| 5,088,168 | A | 2/1992 | Berger et al. | |
| 5,375,311 | A * | 12/1994 | Nabulon | 28/256 |
| 5,653,010 | A | 8/1997 | Grossenbacher et al. | |
| 5,974,777 | A | 11/1999 | Davis | |
| 2002/0035770 | A1 | 3/2002 | Wirz | |
| 2002/0124368 | A1 * | 9/2002 | Serracant et al. | 28/247 |

FOREIGN PATENT DOCUMENTS

| | | |
|---|---|---|
| EP | 1101849 A1 | 5/2001 |
| GB | 1300379 | 12/1972 |

* cited by examiner

*Primary Examiner*—Amy B. Vanatta
(74) *Attorney, Agent, or Firm*—Dority & Manning

(57) ABSTRACT

In a texturing system with a texturing nozzle and a first drum connected thereto and a further drum, a thread is guided on the outlet side of a texturing nozzle at the circumference of a drum in the form of a strip by friction and at least in part in positive manner, so that the longitudinal speed of the strip at the circumference of the drum corresponds with the circumferential speed of the drum in the area of the guide, whereby, by means of a pressure difference in an air guidance system, the effect is achieved by pressing the strip onto the surface of the drum. Further, the thread is guided in relation to its conveying speed and packing density, by positive and friction guidance under the imposition of air, as far as an outlet point on the first drum, and is transferred onto a second drum, on which the strip is cooled, extended if appropriate, and passed on to further guide or conveying rollers, respectively.

13 Claims, 4 Drawing Sheets

TEXTILE MACHINE TEXTURING SYSTEM AND TEXTURING NOZZLE THEREFOR

RELATED APPLICATION

The present application is a Divisional Application of U.S. application Ser. No. 10/349,485 filed on Jan. 22, 2003 now U.S. Pat. No. 6,983,519 which claims priority to German Patent No. 102 02 788.9. Both U.S. application Ser. No. 10/349,485 and German Patent No. 102 02 788.9 are incorporated in their entirety by reference herein for all purposes.

BACKGROUND

The invention relates to a texturing system, or a thread processing device, with a texturing nozzle for forming a textured thread. A nozzle of this generic type is described, for example, in the German published examined application 20 3 6856. The yarn, entering the nozzle from above, is conveyed by a hot-air flow to a compression part, which is provided with passage apertures, for example in slot form. Due to the lateral escape of the air being blown in, and as a result of the reduction in speed in the passage channel, the continuous filament yarn compresses, and thus also incurs a braking effect. The yarn strip which forms is ejected relatively slowly from the nozzle and cooled. In this situation, a rotating cooling drum can be used, on the surface of which the compressed yarn is laid, whereby, as a result of perforations in the drum, air at a lower temperature is sucked into the nozzle, e.g. ambient air, which has the effect of cooling the yarn.

The invention also relates to the compression part of a texturing system, in particular a BCF texturing nozzle, for high velocities. A compression part of a texturing nozzle according to the conventional design is usually formed from an upper and lower lamellar plate holder and a plurality of lamellar plates.

The texturing air and the yarn enter the compression part of high speed from above, i.e. in the direction of flow of the fibres and air respectively. The air flows in the area of the compression part in impart manner through the slots or intermediate spaces between the lamellar plates in a more or less radial direction, and mostly emerges to the outside at the lamellar plates. This has the effect of reducing the air speed in the longitudinal channel of the nozzle. The yarn is braked as a result and forms a strip, which fills the entire inner diameter of the slotted part, namely the compression part. The strip slides downwards through a strip guide tube to a cooling drum or to a conveying device, in particular a pair of rollers.

The strip formation inside the nozzle is influenced by the flow circumstances and geometric conditions which prevail there. If interruptions occur, or specific parameters on which the strip formation depends are altered, the quality of the thread may change impermissibly.

From U.S. Pat. No. 5,653,010, the principle is known of conducting the yarn strip from the texturing nozzle onto a drum and of steering the material flow on the circumferential surface thereof between two rows of needles, which project vertically from the surface. The strip formation in this situation, however, is only influenced at the transition point from the nozzle onto the drum by the conditions which prevail there, which in practice has not led to the desired consistent thread quality.

In EP Application No. 1101 849, it is proposed that the thread be deposited in a drum groove, in order thereby to control the conveyance of the strip better, and at the same time to cool it. In this situation, however, very narrow tolerances are to be maintained in the manufacture of the drum.

SUMMARY

A goal of the invention is to design a thread processing device of such a nature that high production at constant thread quality is attained. Additional objects and advantages of the invention are set forth below in the following description, or may be obvious from the description, or may be learned through practice of the invention.

The thread processing device according to the invention makes provision for a texturing system which is followed by at least one drum for the controlled guidance of the thread with the simultaneous imposition of a guiding and cooling air flow, and, if appropriate, also by a second drum for the complete cooling of the thread.

The thread is conveyed through a nozzle by means of heated compressed air into a storage space and there packed to form a very dense strip. This strip is guided through a guide tube to a first, relatively small cooling drum, and there deposited in a groove, which is precisely as wide as the diameter of the strip. The storage space consists of a short tube with a longitudinal slot, and downstream is expanded to such a degree that no strip is formed by the yarn friction alone on the lamellar plates. Due to the precise guidance of the strip on the cooling drum, this (the guidance) dictates the speed and therefore also the density of the strip. The strip is somewhat cooled in the compressed state by the ambient air sucked into the cooling drum, and then raised by a guidance element or an air jet out of the groove and laid on a second larger cooling drum, designed in the manner of the prior art. It there expands by about the factor of 1.5 to 4, and is fully cooled by the ambient air sucked in. The strip is then again stretched to form a thread and drawn off from a mono or duo.

The invention also relates to a method for the formation of a textured thread in a texturing system with a texturing nozzle and a drum connected thereto, whereby the thread is guided on the outlet side of a texturing nozzle at the circumference of a drum in the form of a strip. For preference, technical air means are provided for, characterized in that, at the circumference of the drum, the strip is cooled by effect from the outside, in particular by means of a blower device, for preference through a blow aperture directed onto the thread run.

In addition, a texturing system is proposed with a texturing nozzle and a drum connected thereto, whereby a guidance system for a strip is provided for on the outlet side of a texturing nozzle, at the circumference of a drum, and technical air means are provided for, in particular for the performance of the process, characterized in that a delivery point for cooling air is provided for at one drum at least, for the issue of a conditioning medium to the strip.

According to the invention, a blower device may be arranged at the circumference of the drum, in general terms a cooling device, with which the thread lying on the surface of the drum is cooled and conditioned in a specific and defined manner. In this situation, this initially involves the rapid cooling of the thread strip running on the circumference of the drum; expressed in other terms, a shock cooling effect, by means of a shoe located on the drum in the run-out area of the strip, which is drawn through a system of holes for the provision of a cooling and conditioning medium respectively.

In addition to, or as an alternative to this, it is possible for a climatisation and simultaneous cooling to be achieved over a substantial circumference of the cooing drum for the strip running over the surface of the drum and moving forwards with it, by the arrangement of an air deflection plate in the area of the thread strip on the drum surface, whereby cooled air is conducted at an angle of about 180° onto the circumferential surface following on from the texturing nozzle. The cooled air is introduced in the area of the air deflection plate onto its side which is turned towards the cooling drum. This deflection plate must not hinder the drawing process of the thread before the system is run up to speed, and, if at all possible, is to be designed so as to pivot. The gap between the cooling drum and the deflection plate should for preference not be greater than 5 mm. The area of the deflection plate directed against the operator is for preference to be made of Plexiglas (Perspex), in order for the operating personnel to be able to evaluate the formation of the strip. The arrangement of the deflection plate which favours the flow is necessary in order to avoid pressure losses.

If cooling air is being introduced as the conditioning medium, then provision is to be made for an air flow of about 1,200–2,500 $Nm^3/h$ for a two-thread cooling drum, i.e. a cooling drum with two thread strips running parallel to one another imposed on it. The air temperature should be infinitely adjustable and regulatable between 5° C. and room temperature. The cooling device required for cooling the air flow should be designed for a capacity of 2,500 $Nm^3/h$. A temperature of the emerging air of max. 5° C. must be assured at an ambient temperature of up to 50° C. The delivery of the cooling air to the surface of the deflection plate is effected, for example, by means of flexible metal hoses. The deflection plate is to be provided with a row of passage apertures, through which the cooled air can be distributed uniformly over the surface of the drum in the area of the strip or strips. Between the surface of the deflection plate, provided with passage apertures, and the feed line for the cooled air, a cover is to be arranged, which has an aperture on the inlet side for the delivery of the air, and is open on the outlet side to the passage apertures, in which situation screening is necessary against the ambient air. The cooling drum is for preference to be subjected to air over what is referred to as a blowing angle of 180° to 240°. This means that the air deflection plate surrounds the drum over an angle from 180° to 240°, with a distance of, for preference, between 3 and 5 mm from the cooling drum surface.

The passage apertures or holes in the shoe referred to heretofore, at the outlet point of the strip on the cooling drum or in the air deflection plate are, for preference, to be designed as multi-row, and extend at least over the width of a groove in the surface of the cooling drum in which the strip comes to lie. The hole diameter is between 0.5 and 1 mm. As media for the cooling or conditioning of the thread strip, consideration may be given to:

Air

Water mist

Water $CO_2$ $N_2$

Spin Finish (water-oil emulsion)

With a drum diameter of, for example, 400 mm, a high texturing capacity can be achieved, with a texturing speed of up to 5,000 m/min.

The attempt should be made to achieve a conditioning of cooling of the thread strip over up to ¾ of the circumference of the drum. By this measure, at least a desired temperature and, for preference, a specific relative humidity can be attained of the thread strip finally running off the surface of the cooling drum.

If two cooling drums are present, the first is to be relatively small in diameter and therefore manufactured economically and more easily with the required precision of concentricity. It can be optimized with regard to its function in respect of the depositing of the strip (very fine perforation in the screen) and lateral strip guidance. The second cooling drum is not critical with regard to precision of concentricity and precision of rotational speed, and can therefore also be economically manufactured. The diameter of this drum, delimited only by the machine layout, allows for a substantial cooling length, and therefore a very high speed potential. The system imposes far fewer high demands on the mutual positioning of the key components than, for example, the Rolltex or the ZIP process from Honeywell.

Thanks to the cooling lengths being of hardly any limit due to the corresponding machine layout, a capacity of 5000 m/min is achievable.

In the texturing device, in particular with a maximum length of the compression part of 60 mm, a guide part with maximum the same length is connected, along which the texturing yarn can be guided in the form of a strip to the surface of the drum, and, subsequent to this first guide part, after a deflection, a second guide part is provided along the surface of the drum, by means of which the textured yarn is guided, on the one hand, in the radial direction as well as in the axial direction of the drum. It is also possible for a third guide part to be connected. By means of the last two parts, a medium can be introduced to the thread strip concerned.

BRIEF DESCRIPTION OF THE DRAWINGS

The invention is described in detail hereinafter on the basis of the drawings. These show.

DETAILED DESCRIPTION

Figure 1B:
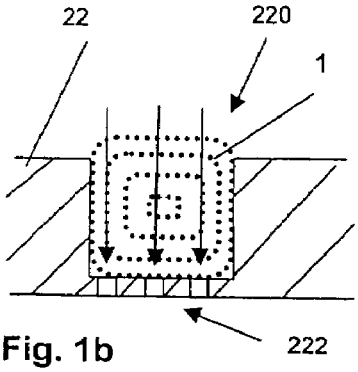
FIG. 1*b*: A meridian view through a part of a drum wall with a strip in transverse section.

Reference will now be made in detail to embodiments of the invention, examples of which are illustrated in the drawings. Each embodiment is presented by way of explanation of the invention, and not meant as a limitation of the invention. It should be apparent that modifications and variations can be made to the embodiments described herein without departing from the scope and spirit of the invention.

Figure 1C:
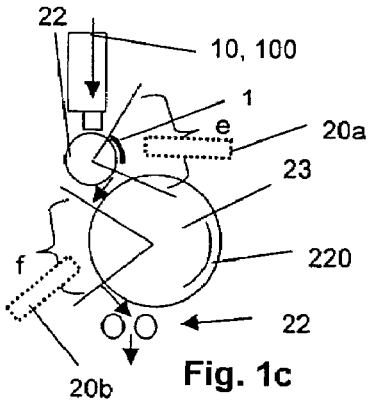
FIG. 1*c*: An overview of the relative location of a nozzle block, and of the first and second drum in relation to each other.
Figure 1:
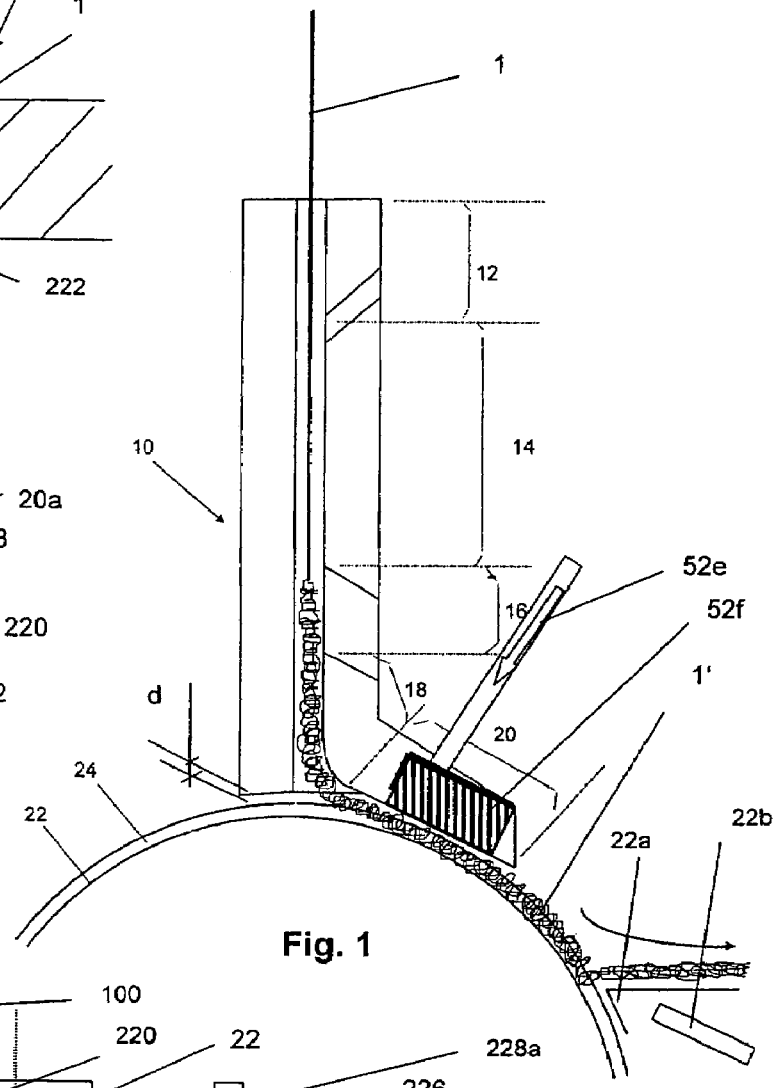
FIG. 1: In diagrammatic form, a section through a texturing nozzle with a cooling drum connected.

The nozzle 10 is shown in FIG. 1 together with a cooling drum 22. The yarn entering from above is guided through an intake part 12 to the point at which hot air or super-heated steam is introduced through channels pointing downwards (there may be one or more channels). This air flows through the subsequent delivery part 14 together with the yarn 1, as far as the entry to the compression part 16. The compression part is for preference formed by lamellar plates or slots oriented longitudinally around the yarn, through which the hot air can flow out radially to the outside. In the compression part 16 is formed what is referred to as the strip 1', which retains its shape and density along a subsequent first guide piece 18 and a second guide piece or "shoe" 20. By contrast with the prior art, the yarn strip is guided further in such a way that it cannot expand. In the transition area between the first guide part 18 and the second guide part 20, the yarn is deflected essentially transverse to its original direction, in the figure pointing downwards. The second guide piece 20 continues over a specific length along the circumference of a rotating perforated drum 22, on the surface of which the textured yarn is guided in a channel 24. The term "second guide piece" is to be understood to mean, on the one hand, a cover over the drum, and, on the other, the groove section in the drum beneath the cover, as well as the combination of cover/groove section, with which the strip 1' is guided on all sides. In the area of the guide part 20 or shoe 20 respectively there is located an inlet point for cooling air, through which the arrow 52*e* in FIG. 1 is pointing. A connection line at 52*e* for the medium referred to, for the conditioning of the thread, is connected at the guide piece or the shoe 20 respectively. Located inside the shoe is a system of drill holes, which is open against the surface of the strip 1'. Inside the shoe is a connection between the delivery line at 52*e* and the drill hole system 52*f*. The strip is therefore, on the one hand, conditioned or cooled by the blowing out of a medium on the surface of the cooling drum, and, on the other, by the subsequent imposition of underpressure on the drum, as described hereinafter.

Underpressure pertains inside the drum, so that cooling air can enter through the strip running on the surface of the drum 22 and through the perforation into the interior of the drum. Due to the narrow guidance arrangement, on the one hand due to the lateral channel walls in a channel, and on the other due to the concentrated air emerging through the floor of the channel, the strip is prevented from making movements relative to the drum. It is therefore guided on a trajectory at the circumference of the drum 22, and retains its shape and density, until the yarn is discharged from the drum 22 by a conveying device, not shown. It is only at this stage that what is referred to as the expansion of the strip takes place.

Major features of the nozzle 10 designed according to the invention, in conjunction with a drum 22, consist of the fact that the yarn strip, after leaving the compression part 16, is prevented from expansion. This is achieved in particular by the deflection between the first guide part 18 and the second guide part 20, as well as by the narrow guidance arrangement in these areas, for example between the second guide part 20 and a channel 24 in the perforated drum 22. With conventional nozzles, in which the textured yarn is laid freely on the surface of a cooling drum, the yarn strip can form loops due to the absence of lateral guidance, as a result of which a partial expansion of the strip takes place. Due to this free emergence of the yarn strip at the outlet of the nozzle, with the prior art as mentioned in the preamble, a more powerful braking effect is necessary in the area of the strip formation, i.e. in the compression part 16, in order to achieve the desired curling effect. This may lead to problems in the event of changes in the operational conditions, which have an influence on the friction coefficient.

Due to the fact that the strip is prevented from changing shape in or at the guide piece 18 and 20 respectively following the compression part 16, the texturing of the yarn in this part of the nozzle is better stabilized than with conventional nozzles.

Figure 1A:
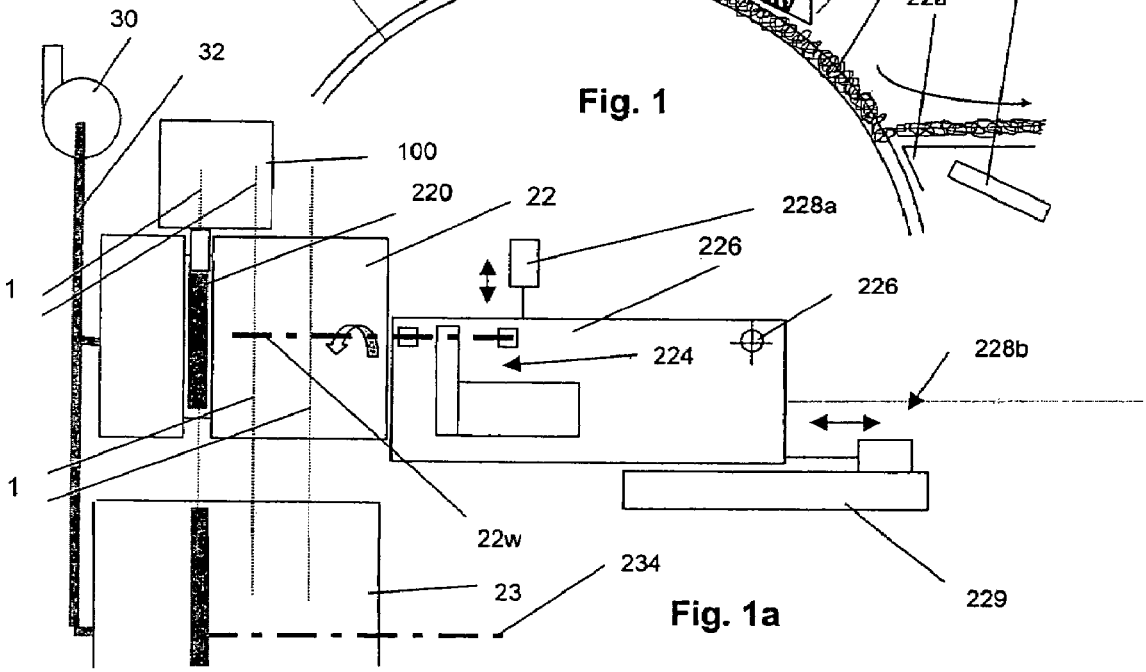
FIG. 1*a*: A plan view of a texturing system in diagrammatic representation.

According to FIG. 1*a*, a nozzle block 100, in which several texturing nozzles can be assembled, is arranged at a first drum 22, in accordance with the side view in FIG. 1. In each case, a nozzle 10 and a second guide part 20 are located close to a groove 220, or in the channel 24 respectively. The drum wall is perforated in the area of the groove 220, indicated in FIG. 1*a* by the grey area located inside the area of the groove 220. The thread runs of the filament yarn 1 from the nozzle block 100 to the first drum 22, and onwards to a second drum 23, are indicated by thin dotted lines. The drum 23 is, as for preference is the drum 22, provided with a perforation in the area of the thread run of a thread 1, as indicated by the grey marked areas within the circumference of the drums. Through these perforations, or boreholes, air enters the interior of the drums, since the interior of the drums is subjected to under-pressure by the connection of a fan 30 via a channel 32. In this situation, different pressure levels may pertain in the individual interior chambers of the drums 22 and 23. While the air, flowing through the boreholes 222 according to FIG. 1*b* into the interior of the drum 22 transversely through the strip 1' in accordance with the direction of the arrow into the groove 220, and which enters the interior through boreholes in accordance with FIG. 1*b*, serves in particular to hold the strip 1' securely on the floor of the groove, and secondly also serves to cool it, the air entering the second drum 23 has the task in particular of cooling the thread, so that is drawn off by conveyor rollers on the discharge side of the drum 23 cooled down to ambient temperature, and can be further wound onto a spool. The boreholes 222 in the wall of the first drum 22 are for preference produced by material-removing machining or by erosion, while the second drum 23 may exhibit a casing of perforated sheet metal, since it does not have to be manufactured with narrow manufacturing tolerances. By contrast with this, the first drum 22 is for preference machined with the removal of material at least on the outer circumference, in order for it to be arranged at a very short distance from the nozzle block 100. The following dimensions, or parameters, are to be respected for preference:

| | |
|---|---|
| Outer diameter of the first drum 22 | 100 . . . 200 mm |
| Depth of groove 220 | 4 . . . 8 mm |
| Width of groove 220 | 6 . . . 10 mm |
| Diameter of boreholes 222 | 0.5 . . . 1 mm |
| Number of boreholes 222 on the floor of the groove | 2,000 . . . 10,000 |
| Number of thread tracks or grooves 220 per drum 22 | 2 to 6 (8) |
| Distance between nozzle 10 or second guide part 20 and the outer circumference of the drum 22 | 0.5 . . . 2 mm |
| Outer diameter of the second drum 23 | 300 . . . 1000 mm |
| Temperature of the air or steam flowing into the nozzle 10 | 160 . . . 200° C. |
| Temperature of the strip 1' when running off the drum 22 and when running onto the drum 23 respectively | 60 . . . 100° C. |
| Contact angle of the strip 1' on the first drum 22 from the run-on point at the nozzle 1 to run-off point at a guide element 22a | 120 . . . 270° C. |
| Ratio of the speed of the thread entering the nozzle 10 to the circumferential speed of the drum 22 | 50 . . . 120 |

Attention may be drawn to the fact that the strip is indeed formed in the texturing nozzle 10, but its departure speed and packing density are not controlled in the nozzle, since it is only inadequately braked inside the nozzle channel, as a result of the weak friction of the strip inside the compression part 16, or the guide part 18 respectively. This is the result, therefore, of the fact that the cross-section of the channel in the compression part 16 or in the first guide piece 18 respectively, decreased comparatively sharply in the direction of the material flow, corresponding to a cone angle of 1 to 10 degrees, if the inner wall of the compression part 16 or of the guide part 18 respectively is designed in conical form.

As already mentioned, a precise and narrow position of a texturing nozzle 10 to the thread track concerned on the first drum 22 is necessary, since the departure speed and packing density of a strip is determined not in the texturing nozzle itself, but only at the circumference of the first drum. To draw the threads into the texturing system, the first drum 22 must be moved away from the nozzle block 100 or from the texturing nozzles 10 respectively, which is brought about to advantage by the pivoting or sliding of the drum 22 away from the nozzle block 100. It would likewise be possible for the nozzle block 100, or an individual texturing nozzle 10 respectively, to be moved away from the first drum 22 by means of a slide device. According to FIG. 1*a*, a drum 22 can be connected via a shaft, indicated by a broken line, to a drive unit 224 with bearings, which is securely mounted in a carrier element 226. The drive unit 224 consists for preference of a(n) (asynchronous) motor controlled or regulated by means of a frequency converter, in a structural unit with a reduction gear system, whereby the drum shaft 22*w* is guided by at least two bearings at the drive unit 224. The carrier part 226 can be designed as a housing, which is located either in a pivot bearing 226' in a frame, or can be mounted in a guide bearing 229. In the first variant, a pivot device 228*a* is to be provided for moving the drum 22 away from the nozzle block 100, while in the other case, with the displacement ability of the carrier part 226 in the guide bearing 229, a displacement device 228*b* is required. The latter devices are for preference provided with pneumatic or hydraulic drive cylinders.

Like the first drum 22, the second drum 23 also exhibits a drive unit 234 with bearing, whereby this can likewise exhibit an independent revolution-speed controlled electric motor.

As is shown in FIG. 1, the densely-packed strip 1' is guided at the circumference of the first drum 22 with the guide part 20, or in the 220 respectively, until the run-out point, whereby the run-out of the strip in the direction onto the second drum 23 is effected by a guide element 22*a* or a blower device 22*b*.

According to FIG. 1*c*, a contact area e for the thread 1 or strip 1' is provided at the drum 22, as well as a contact area f at the drum 23. The deflection of the thread or strip in the area e amounts for preference to 180 . . . 270 degrees, and in the area f between 90 and 270 degrees. The run directions of the thread or strip are indicated by a sequence of arrows. The drums exhibit a depression, for preference a groove 220, as the run point of each thread.

According to FIG. 1*c*, a second and/or third blower device 20*a*, 20*b* for cooling air can be arranged at the circumference of the drums 22 and 23, with blow-out apertures directed onto the thread run.

Figure 4:
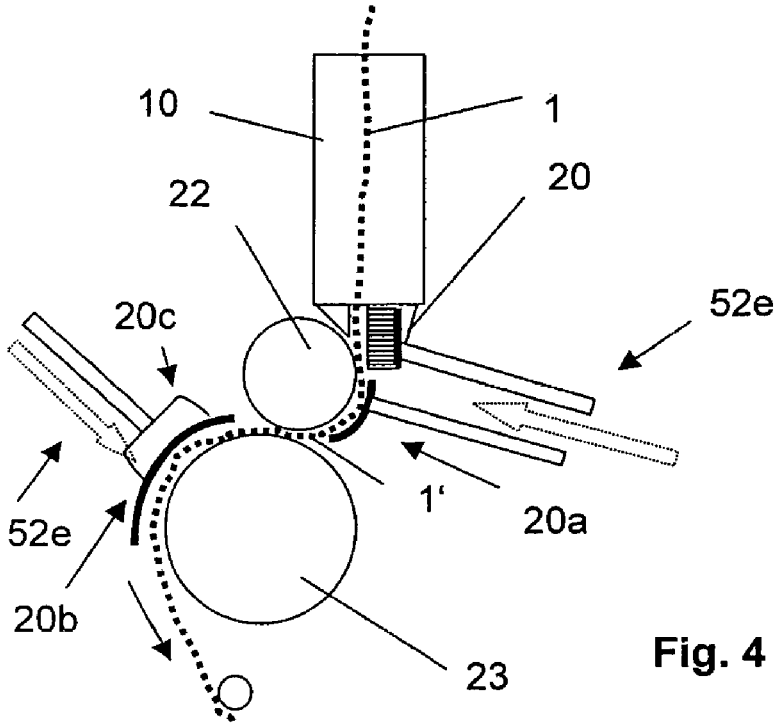
FIG. 4 and FIG. 4*a*: Cooling devices, and cooling air delivery devices respectively.

The second and/or third, as appropriate, blower device respectively are designed arranged as in connection with the description of FIG. 4.

Figure 2:
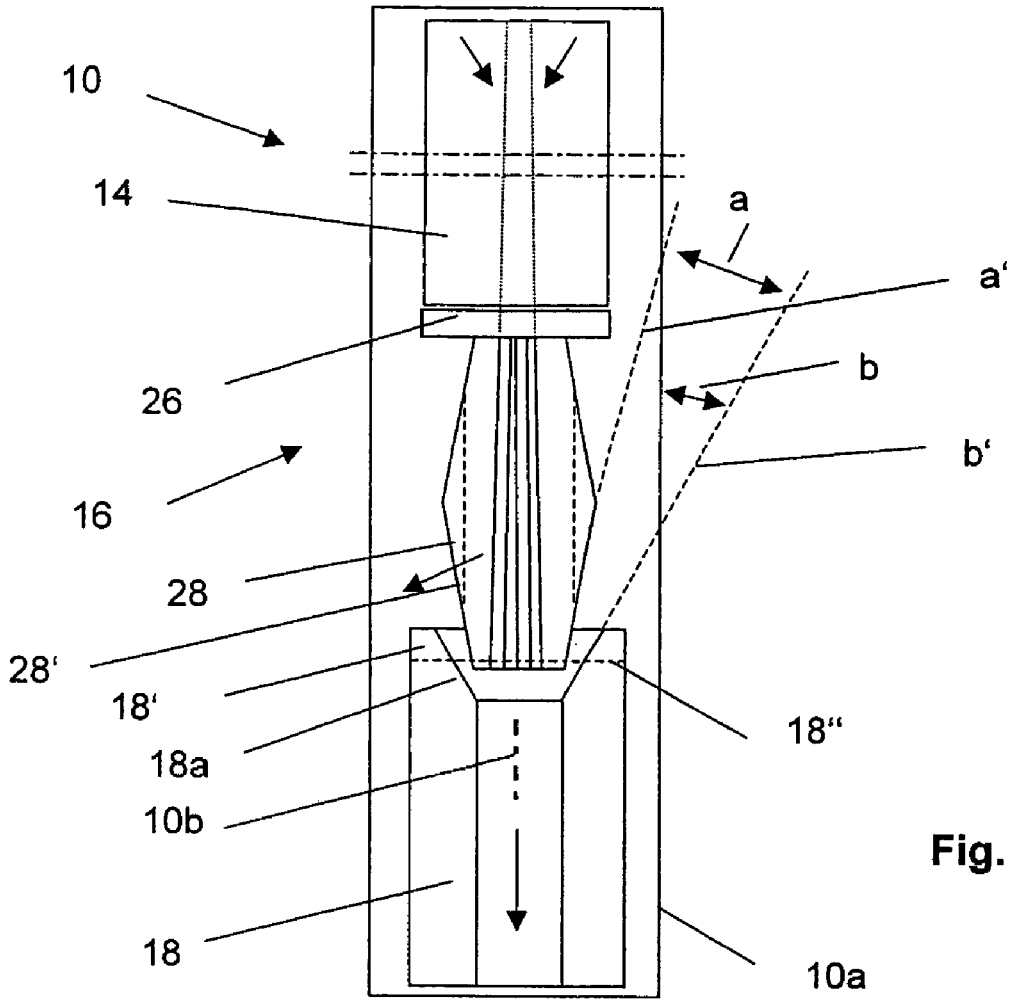
FIG. 2: A section through a texturing nozzle according to the invention, in a diagrammatic representation.

According to FIG. 2, the nozzle 10 is likewise divided into a delivery part 14, a compression part 16, and a guide part 18, where by the latter is also referred to as the strip guide tube. In the delivery part 14, in accordance with the arrows drawn in at the top, air enters laterally into a delivery channel, through which the yarn which is to be textured is conducted downwards. The compression part is divided according to the embodiment example into a lamellar plate holder 26, in which lamellar plates 28 are located at the bottom, which are arranged in a plurality of circles, so that slots or gaps are formed between the lamellar plates, through which, in the area of the compression part 16, the air emerges in the direction of the arrow at 28 more or less radially through the slots between the lamellar plates. The lamellar plate holder 26 can be designed as a flange, which is either designed as a single piece together with the lamellar plates 28, which is inserted into the lamellar plate holder, and, for example, can be connected with it by soldering. The outer contour 28' of the lamellar plates can, as indicated by extended lines, run obliquely to the flow direction of the air or the conveying direction of the yarn respectively, or the lamellar plates can, as indicated by the broken line, be arranged essentially parallel to the direction of flow, and run together at least on the outlet-side end of the strip obliquely to the conveying direction, so that, on the outlet side, the outer edges of the lamellar plates essentially form a circular truncated cone, said circular truncated cone projects into an end piece 18' or into the guide part or the strip guide tube 18, whereby the end piece 18' or the guide piece 18 respectively likewise exhibit a truncated cone surface. For preference, the lamellar plates 28 on the outlet side, and the end piece 18' or the guide piece 18 on the inlet side, are designed in such a way that between the outer contour 28' of the lamellar plates 28 and the inner surface of the end piece 18' or the guide 18, a narrow gap of approximately constant height is formed. This gap likewise has the form of a circular truncated cone.

Expressed in general terms, the angle "a" between a first extension or projection line a' at the outlet-side outer contour 28' of a lamellar plate 28, and a second extension line b' in an extension of a casing line of the circular truncated cone on the inlet side of the guide part 18, forms a first angle a, while the second extension line b' encloses an angle b with an edge 10*a* of the nozzle 10. For preference, the following ranges are proposed for the angles a and b: a=0 . . . 1 . . . 4°, b=30 . . . 45 . . . 60°, whereby the values underlined have in practice transpired to be favourable. A separation plane 18" may be located between the end piece 18' and the first guide part 18.

Figure 3:
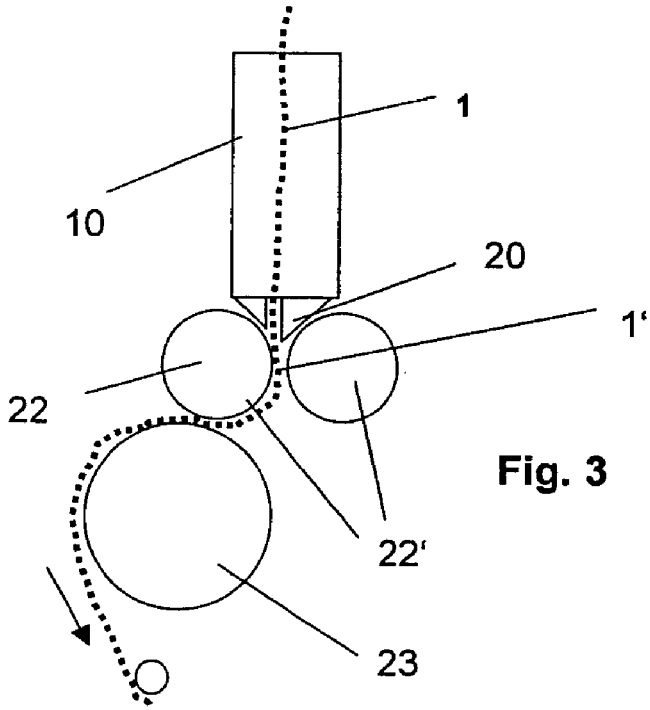
FIG. 3: An overview drawing of a texturing nozzle with rollers or drums connected to it.

In FIG. 3 a diagrammatic representation is once again provided showing that, following on from a nozzle 10, either a pair of delivery rollers 22, 22' can be provided, to draw off the yarn strip which has been formed, or a single drum 22, over the surface of which the strip is guided off in a controlled manner, as is described in the German Patent Application DE 199 55 227.4. The latter application is to be regarded as an integral part of the present application and is thus incorporated herein by reference.

Figure 4A:
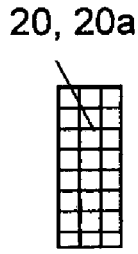

According to FIG. 4, as has already been represented in greater detail in FIG. 1, and explained in connection with the corresponding description, at the outlet point of the thread on the drum 22, a guide 20 or a shoe 20 respectively is located, through which an inlet point 52*e* leads for cooling air or another medium, into the interior of the guide 20 or the shoe 20, in which, as already mentioned, a system of boreholes or passage apertures is located. FIG. 4*a* shows, in a view from the left onto the parts in FIG. 4, the plan view onto the side of the shoe 20 turned towards the drum, or of the air deflection plate at the blower device 20*a*. The air deflection plate, as likewise for the blower device 20*b*, is represented with a sharply drawn out pivoted line in the side view onto the arrangement. The passage apertures can, according to FIG. 4*a*, be circular passages or of another shape. In FIG. 4, an air inlet point for cooling air is represented at the drum 23, with a connection stub next to the arrow at 52*e* and a cover, connected on one side to the connection stubs and on the other to an air deflection plate, which is tensioned above the surface of a cooling drum, designated here by 23. The blower device 20*a* is accordingly also capable of being drawn out. The medium, or the cooling air in particular, is therefore, with a design with two cooling drums 22 and 23, conducted via the shoe 20, on further by a blower device 20*a* and 20*b*, for preference formed by means of a connection stub and a cover with air deflection plate, designated in FIG. 4 by 20*c*.

Figure 5:
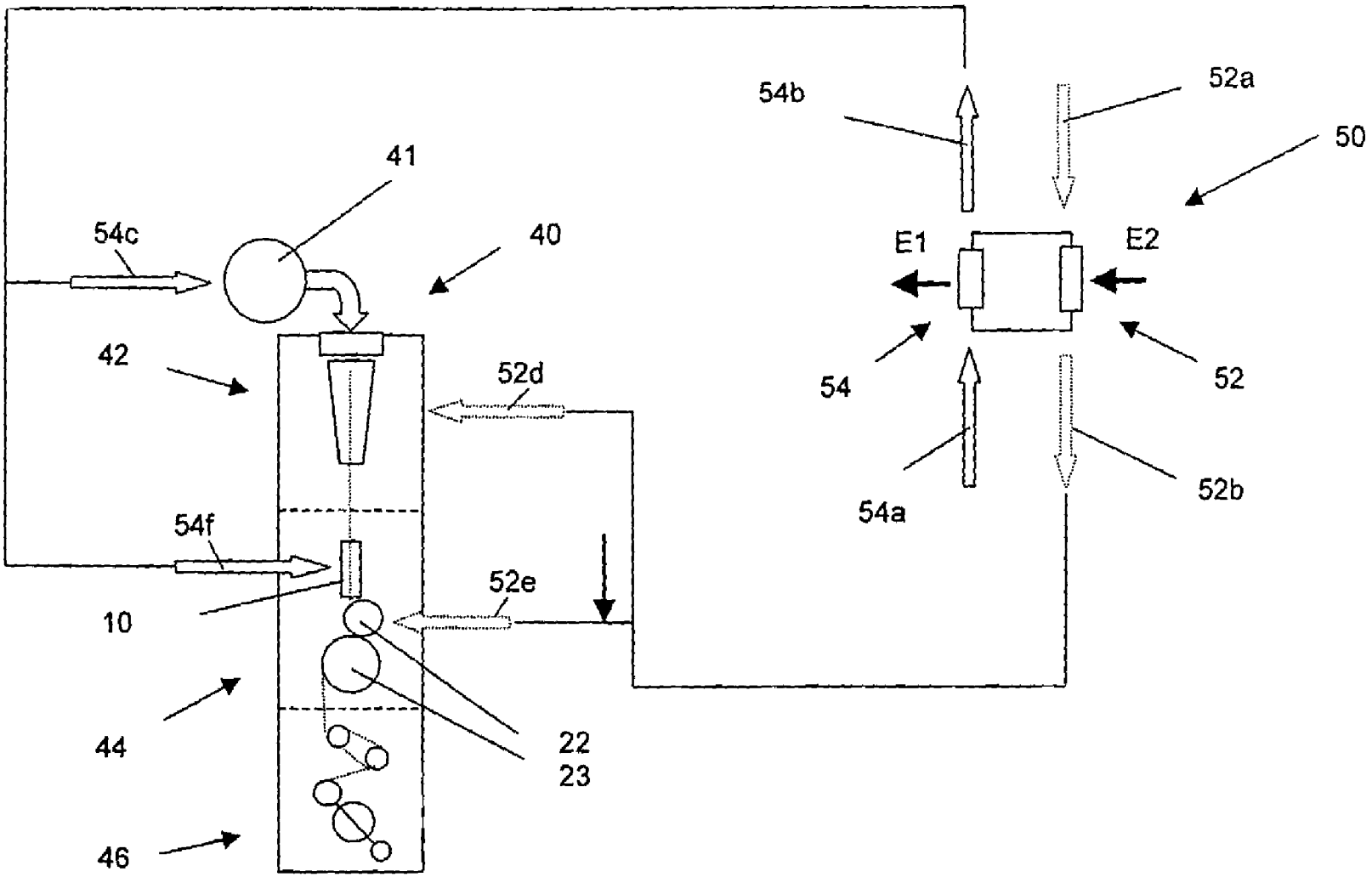
FIG. 5: An air guidance system in schematic form for the entire thread production system.

FIG. 5 represents an overview of a production system 40 for textured filament yarn, taking into consideration the air flows for cooled air or for heated air. Plastic material is heated by an extruder 41, and conducted to the spinning device 42 with a spinning beam and a cooling shaft. Located beneath this is a texturing system 44 with texturing nozzles 10, as represented in FIG. 1 and described in greater detail in the corresponding description. The texturing system 44 further comprises at least one, or, as indicated in FIG. 5, two cooling drums 22, 23 with an inlet point 52*e* analogous to the inlet point 52*d* at the spinning device 42 for cooled air. Located in turn beneath the texturing system 44 is a stretching device and a winding device 46 for the textured material.

With a larger production system it may be of advantage to provide for an energy exchange arrangement for the cooling or heating of air by means of a cooling system 50. In the cooling system 50 is an inlet point 52*a* for ambient air, as well as a draw-off point 52*b* for cooled air, indicated in each case by dotted arrows. The cooling system comprises, for example, an evaporator 52 with a heat exchanger for a cooling medium, whereby, by the evaporation of the cooling medium, energy is drawn from the ambient air inflowing at 52*a*, whereby this air is cooled to the required degree and conducted onwards through the draw-off point 52*b* to the production system 40. In this situation, the energy drawn from the inflowing ambient air is conducted to the evaporator 52 per time unit E2 or per power unit, indicated by the arrow E2. In the circuit process for the cooling medium, this medium passes on the other side to a compressor 54 with heat exchanger for cooling the cooling medium which has been heating by the compression. In a further heat exchanger at the compressor 54, energy E1 is drawn off from the cooling medium, indicated by the arrow at E1, this energy being conducted to the ambient air introduced at the intake point 54*a*. This heated air, drawn off at the removal point 54*b* of the cooling system, can be used, for example, for heating the extruder 41, being conducted to this at the intake point 54*c*, or, for texturing at the texturing nozzles 10, at least for heating the air which is required at that location. The air which is cooled at the draw-off point 52*b* is, on the other hand, conducted in particular at the inlet point 52*e* to the cooling drums 22, 23, as shown in detail in connection with the figure description of FIG. 4. The air inlet routes are represented in simplified form; it is understood that, in order to maintain the desired temperature in each case at the points concerned, further measures are necessary, such as an electrical heating device at the extruder 41 or an admixture of additional air, indicated by the extended arrow at 52*e*. The inlet points 52*d* and 52*e* respectively for cooling air at the quenching cell of the spinning device 42 and at the texturing system 44 are indicated with dotted arrows, corresponding to the inlet points for heating air at the inlet points 54*c* and 54*f* with extended arrows.

The energy E2 in the cooling circuit, conducted to the evaporator in the corresponding heat exchanger, is smaller per time unit or the corresponding power output, than the energy converted in the heat exchanger at the compressor 54, i.e. the energy introduced to the inflowing air, per time unit and per power unit E1. The difference corresponds to the power to be applied in the compressor 54 to the cooling medium in the cooling system 50.

It should be apparent to those skilled in the art that modifications and variations can be made to the embodiments of the invention described herein without departing from the scope and spirit of the appended claims and their equivalents.

What is claimed is:

1. A system for texturing thread, comprising:

a texturing nozzle disposed for receipt of a thread, said texturing nozzle forming the thread into a thread strip;

a first cooling drum disposed at an outlet of said texturing nozzle for receipt of the thread strip, said first drum having an interior subjected to an under-pressure such that the thread strip is held against said first drum;

a guide mechanism disposed at an outlet of said texturing nozzle along at least a portion of a circumference of said first drum, said guide mechanism configured to guide the thread strip from said texturing nozzle onto the circumference of said first drum in a controlled manner and under constant conditions such that a longitudinal speed of the thread strip corresponds to a circumferential speed of said first drum along said guide mechanism;

a second cooling drum disposed for receipt of the thread strip from said first cooling drum; and a guide element disposed at a circumferential location along said first cooling drum downstream of an outlet of said guide mechanism to convey the thread strip away from the circumference of said first cooling drum and onto the circumference of said second cooling drum.

2. The texturing system as in claim 1, wherein said first cooling drum has a perforated circumferential surface such that air is drawn through said perforated surface by said under-pressure thereby cooling the thread strip and adhering the thread strip to said circumference of said first cooling drum.

3. The texturing system as in claim 1, wherein said first cooling drum has an outer diameter of about 100 to 200 mm and is disposed at a distance of about 0.5 to about 2.0 mm from said texturing nozzle outlet, said guide element disposed at an angular position along said circumference of said of first cooling drum of between about 120 to about 270 degrees from said texturing nozzle outlet.

4. The texturing system as in claim 1, wherein said texturing nozzle is disposed in a nozzle block.

5. The texturing system as in claim 1, wherein said guide mechanism comprises a circumferentially extending groove defined in said first cooling drum, said groove having a width corresponding to a width of the thread strip.

6. The texturing system as in claim 5, further comprising perforations defined in a bottom surface of said groove such that air is drawn through said perforated bottom surface by said under-pressure thereby cooling the thread strip and adhering the thread strip within said groove.

7. The texturing system as in claim 6, wherein said perforations have a diameter between about 0.5 to about 1.0 mm.

8. The texturing system as in claim 6, wherein said groove comprises a trough-shaped cross-section having a width of between about 6.0 to about 10.0 mm and a depth of between about 4.0 to about 8.0 mm.

9. The texturing system as in claim 1, wherein said first cooling drum is movably mounted relative to said texturing nozzle.

10. The texturing system as in claim 9, wherein said first cooling drum is mounted on a movable carrier part so as to be movable with respect to said texturing nozzle.

11. The texturing system as in claim 9, wherein said first cooling drum is pivotally mounted relative to said texturing nozzle.

12. The texturing system as in claim 1, wherein said first cooling drum is mounted on a drive shaft, said drive shaft connected to a direct drive with bearings.

13. The texturing system as in claim 1, wherein said first cooling drum has a diameter between about 100 to about 200 mm, and said second cooling drum has a diameter between about 300 to about 1,000 mm.

* * * * *